United States Patent [19]

Silverman

[11] Patent Number: 4,908,867

[45] Date of Patent: Mar. 13, 1990

[54] SPEECH SYNTHESIS

[75] Inventor: Kim E. A. Silverman, Murray Hill, N.J.

[73] Assignee: British Telecommunications public limited company, United Kingdom

[21] Appl. No.: 122,804

[22] Filed: Nov. 19, 1987

[51] Int. Cl.[4] ..... G10L 5/02

[52] U.S. Cl. ..... 381/51; 381/38

[58] Field of Search ..... 381/38, 44, 51, 36

[56] References Cited

U.S. PATENT DOCUMENTS 3,704,345 11/1972 Coker et al. ..... 381/44

4,344,148 8/1982 Brantingham et al. ..... 381/51

OTHER PUBLICATIONS

"Review of Text-to-Speech Conversion for English"; Journal of the Acoustic Society of America, vol. 82, #3, Sep. 1987, pp. 761-762, 767, 769.

"Intonation in Text-to-Speech Synthesis: Evaluation of Algorithms"; Journal of the Acoustical Society of America, vol. 77, #6, Jun. 1987, pp. 2158-2159.

Synthesizing Intonation by Janet Pierrehumbert-Bell Laboratories, Murray Hill, N.J., 07074, accepted for publication 8 Jun. 1981.

J. Accoust. Soc. Am. 70(4), vol. 70, No. 4, Oct. 1981, 99, 985-995.

Intonational Invariance under Changes in Pitch Range and Length-by Mark Liberman and Janet Pierrehumbert-pp. 157-233.

A study of the perception of sentence intonation-Evidence from Danish-Nina G. Thorsen-J. Acous. Soc. Am. 67(3), Mar. 1980, pp. 1014-1030.

*Primary Examiner*—Peter S. Wong

*Assistant Examiner*—Judson H. Jones

*Attorney, Agent, or Firm*—Nixon & Vanderhye

[57] ABSTRACT

Coded text is converted to phonetic data to drive a synthesis filter. Accent data are also obtained to derive a pitch contour for a variable pitch excitation source. Recognition of the beginning of a paragraph causes a pitch contour of higher pitch than the pitch at a later part of the paragraph. The initial pitch falls following each subgroup into which phrases are divided. Accents within a phrase are assigned pitch values which are high for the first accent, less high for the last; and the remainder alternate between higher and lower lesser values. Accents on repeated words may be suppressed.

13 Claims, 6 Drawing Sheets

SPEECH SYNTHESIS

The present invention is concerned with the synthesis of speech from text input. Text to speech synthesisers commonly employ a time-varying filter arrangement, to emulate the filtering properties of the human mouth, throat and nasal cavities, which is driven by a suitable periodic or noise excitation for voiced or unvoiced speech. The appropriate parameters are derived from coded text with the aid of rules and dictionaries (lookup tables).

Such synthesisers generally produce speech having an unnatural quality, and the present invention aims to provide more acceptable speech by certain techniques which vary the pitch of the periodic excitation.

According to one aspect of the invention there is provided A speech synthesiser comprising:

(a) means for deriving, from coded text input thereto, phonetic data indicative of the properties of a synthesis filter and accent data indicating the occurrence of accents on words and to identify phrase groups of words delimited by punctuation marks;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein each phrase group comprises one or more subgroups and the deriving means are arranged in operation in response to paragraph division within the text to produce a pitch contour which for a given textual content is higher at the commencement of a paragraph than at an intermediate part of the paragraph by a factor which, from its value at the commencement of the paragraph, falls following each subgroup.

In another aspect the invention provides a speech synthesiser comprising:

(a) means for deriving, from coded text input thereto, phonetic data indicative of the properties of a synthesis filter and accent data indicating the occurrence of accents on words and to identify phrase groups of words delimited by punctuation marks;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein the deriving means are arranged in operation to assign pitch representative values to the accents within each phrase group, the values comprising:

(i) a first value assigned to the first accent in the group;

(ii) a second value, lower than the first, assigned to the last accent in the group;

(iii) further values, lower than the first and second values, assigned to the remaining accents in the group such that the majority of those further values form a sequence in which the difference between successive values is alternately positive and negative and to derive a pitch contour from those values.

In a further aspect of the invention there is provided a speech synthesiser comprising:

(a) means for deriving, from coded text input thereto, phonetic data indicative of the properties of a synthesis filter and accent data indicating the occurrence of accents on words;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein the deriving means are arranged in operation to suppress accents on words which, in accordance with a predetermined criterion, resemble words previously processed.

Other optional features of the invention are defined in the appended claims.

Some embodiments of the present invention will now be described, by way of example, with reference to the accompanying drawings, in which.

Figure 1:
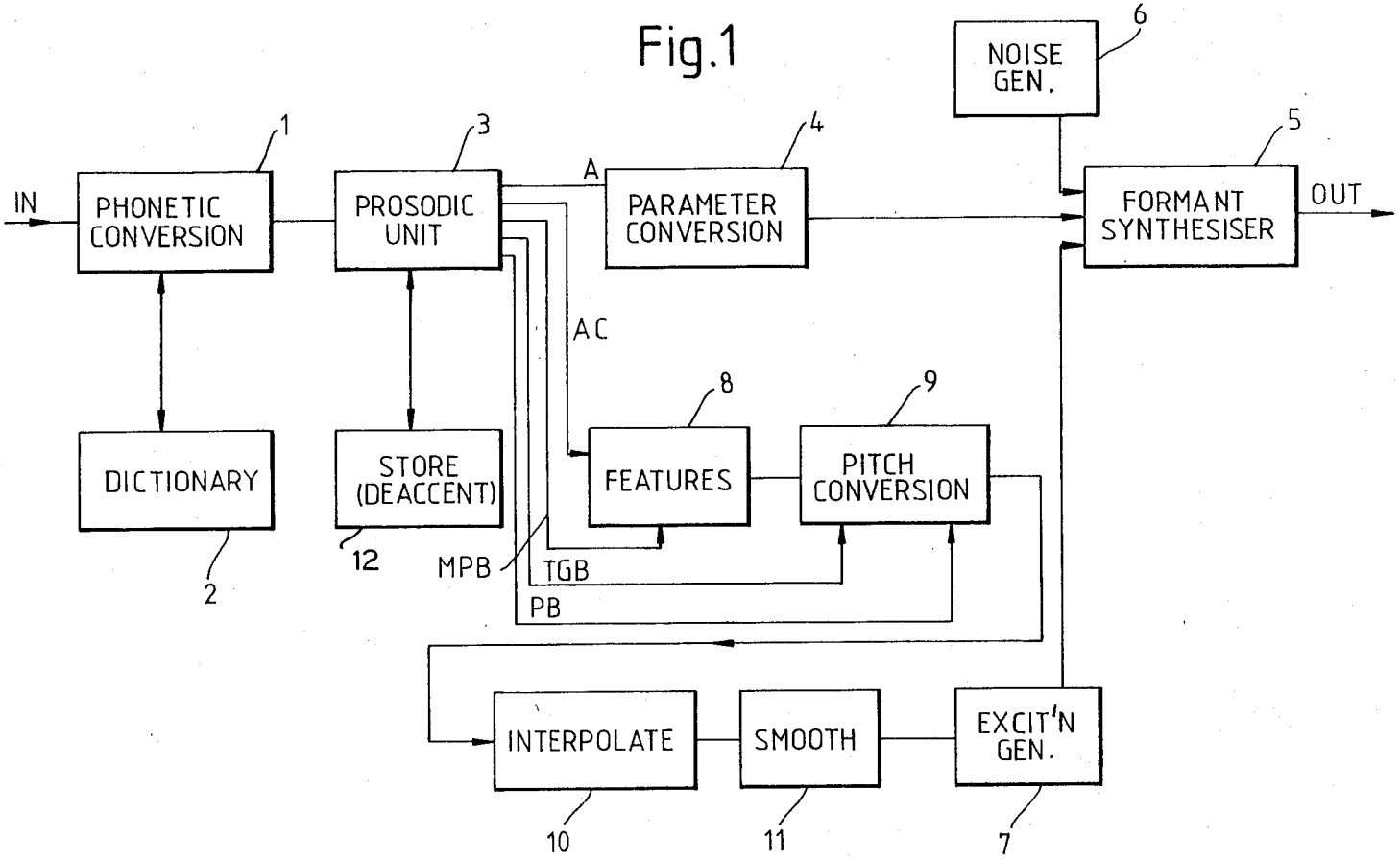
FIG. 1 is a block diagram of a text-to-speech synthesiser.
Figure 2:
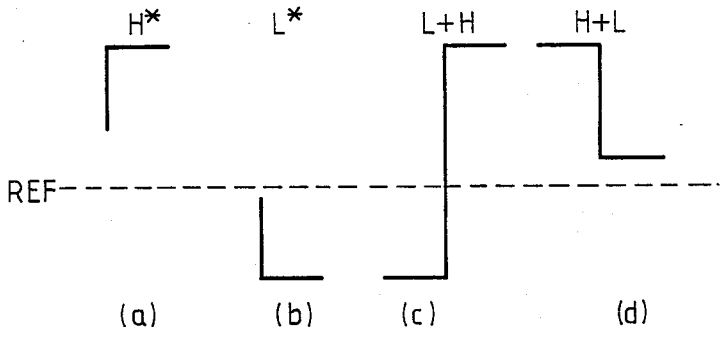
FIG. 2 illustrates some accent feature shapes.

Referring to FIG. 1, the first stage in synthesis is a phonetic conversion unit 1 which receives the text characters in any convenient coded form and processes the text to produce a phonetic representation of the words contained in it. Such conversions are well known (see, for example "DECtalk", manufactured by Digital Equipment Corporation).

Additionally, the conversion unit 1 identifies certain events, as follows:

As is known, this conversion is carried out on the basis of a dictionary in the form of a lookup table 2, with or without the assistance of pronunciation rules. In addition, the dictionary permits the insertion into the phonetic text output of markers indicating (a) the position of the stressed syllables of the word and (b) distinguishing significant ("content") and less significant ("function") words. In the sentence "The cat sat on the mat", the words cat, sat, mat are content words and the, the, on are function words. Other markers indicate the subdivision of paragraphs, and major phrases, the latter being either short sentences or parts of sentences divided by conventional punctuation. The division is made on the basis of orthographic punctuation-viz. carriage return and tab characters for paragraphs; full-stops, commas, semicolons, brackets, etc., for major phrases.

The next stage of conversion is carried out by a unit 3, in which the phonetic text is converted into allophonic text. Each syllable gives rise to one or more codes indicating basic sounds or allophones, e.g. the consonant sound "T", vowel sound "OO", along with data as to the durations of these sounds. This stage also identifies subdivisions into tone groups. A tone group boundary is placed at the junction between a content word and a function word which follows it. It is however, suggested that no boundary is placed before a function word if there is no content word between it and the end of the major phrase. Further, the positions within the allophone string of accents is determined. Accents are applied to content words only (identified by the markers from the phonetic conversion unit 1). The positions of accents, major phrase boundaries, tone group boundaries and paragraph boundaries may in practice be indicated by flags within data fields output by the unit 3; however for clarity, these are shown in FIG. 1 as separate outputs AC,MPB,TGB and PB, along with an allophone output A.

The allophones are converted in a parameter conversion unit 4 into actual integer parameters representing synthesis filter characteristics and the voiced or unvoiced nature of the sound, corresponding to intervals of, typically, 10 ms.

This is used to drive a conventional formant synthesiser 5 which is also fed with the outputs of a noise generator 6 and (voiced) excitation generator 7.

The generator 7 is of controllable frequency and the remainder of the apparatus is concerned with generating context-related pitch variations to make the speech more natural sounding than the "mechanical" result so characteristic of basic synthesis by rule synthesisers.

The accent information produced by the conversion unit 3 is processed to derive a time varying pitch value to control the frequency of the excitation to be applied to conventional formant filters within the formant synthesiser 5. This is achieved by (a) generating features in a time-pitch plot, (b) linear interpolation between features, and (c) filtering to smooth the result.

It is observed that intonation of a given phrase will vary according to its position within a paragraph and to accommodate this the concept of "prominence" is introduced. This is related to pitch, in that, all things being equal, a large prominence value corresponds to a higher pitch than does a small prominence value, but the relationship between pitch and prominence varies within a paragraph.

Figure 3:
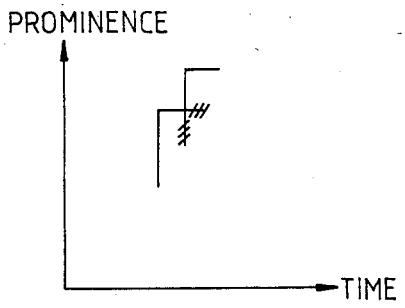
FIG. 3 illustrates the effect of overlapping shapes.

The generation of features (illustrated schematically by feature generator 8) is as follows:

(a) Each accent gives rise to a feature consisting essentially of a step-up in pitch. A typical such feature is shown in FIG. *2a*. It defines a lower, starting prominence and a higher, finishing prominence value. It is followed by a period of constant prominence value. Instead, or as well, the feature (FIGS. *2c*) may be preceded by a period of constant prominence. Falling accents may if desired also be used (FIG. *2b*, *2d*). Typically the difference between higher and lower prominence values may be fixed. The actual value of the prominence is discussed below. If two features overlap in time, the second takes over from the first as illustrated in FIG. 3 where the hatched lines are disregarded.

(b) A tone group division creates a point of low prominence (e.g. 0.2).

(c) Within a major phrase, the accents are assigned (finishing) prominence values as follows:

(i) the first accent is given a high value (e.g. 1)

(ii) the last accent is given a moderately high value (e.g. 0.9).

(iii) the intermediate accents alternate between higher and lower lesser values (e.g. 0.85/0.75), starting on the higher of these. If there is an odd number of accents then the penultimate accent takes the lower, instead of the higher, value.

One advantage of the scheme described at (c) is that it requires only a limited look-ahead by the feature generator 8. This is because:

(i) The first pitch accent in a major phrase always has a prominence of 1.0 (i.e. no look-ahead necessary).

(ii) If the second pitch accent is the last in the major phrase then it is assigned a prominence of 0.9, otherwise 0.85 (i.e. look-ahead by one pitch accent).

(iii) If the third pitch accent is phrase-final then it is assigned a prominence of 0.9, otherwise 0.75. This applies to all subsequent odd-numbered pitch accents in the major phrase (i.e. look-ahead by one pitch accent).

(iv) For the fourth and all subsequent even-numbered pitch accents: if phrase-final then 0.9, if the next is phrase-final then 0.75, otherwise 0.85 (i.e. look-ahead by up to two pitch accents).

The alignment of accents in time will normally occur at the end of the associated vowel sound; however, in the case of the heavily accented end of a minor phrase it preferably occurs earlier—e.g. 40 ms before the end of the vowel (a vowel typically lasting 100 to 200 ms).

Figure 4:
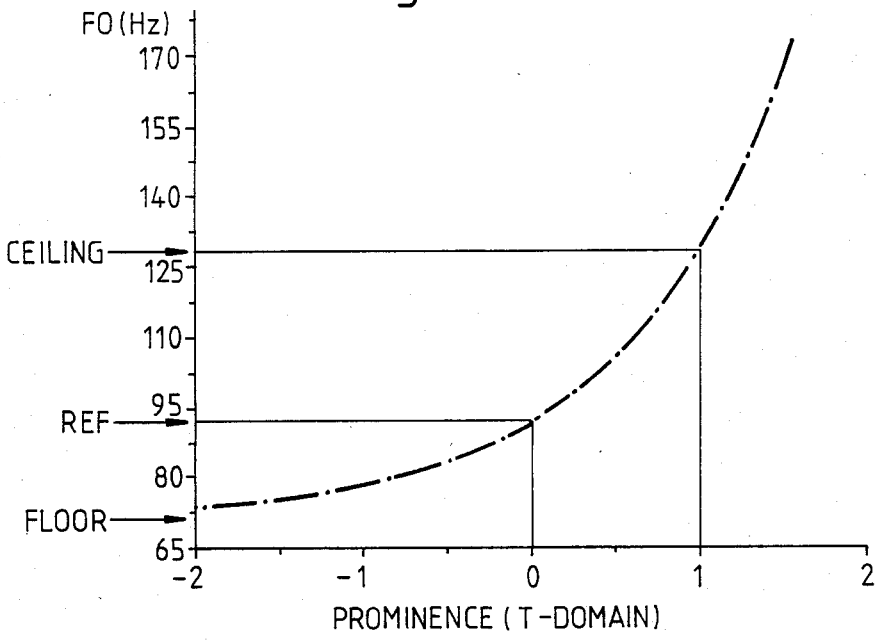
FIG. 4 is a graph of pitch versus prominence.

The next stage is a pitch conversion unit 9, in which the prominence values are converted to pitch values according to a relationship which is generally constant in the middle of a paragraph. Since the prominence values are on an arbitrary scale, it is not meaningful to attempt a rigorous definition of this relationship. However, a typical relationship suitable for the prominence values quoted above is shown graphically in FIG. 4 with prominence on the horizontal axis whereas the vertical axis indicates the pitch.

This is a logarithmic curve $f = fo + U.L^T$ where fo is the bottom of the speaker's range, L is the proportion of the speakers range represented by U, and T is the prominence (or, in the case that an accent may unusually involve a drop in pitch, the negative of the prominence).

The use of the logarithmic curve is useful since equal steps in prominence then correspond to equal perceived differences in the degree of accentuation.

Figure 5:
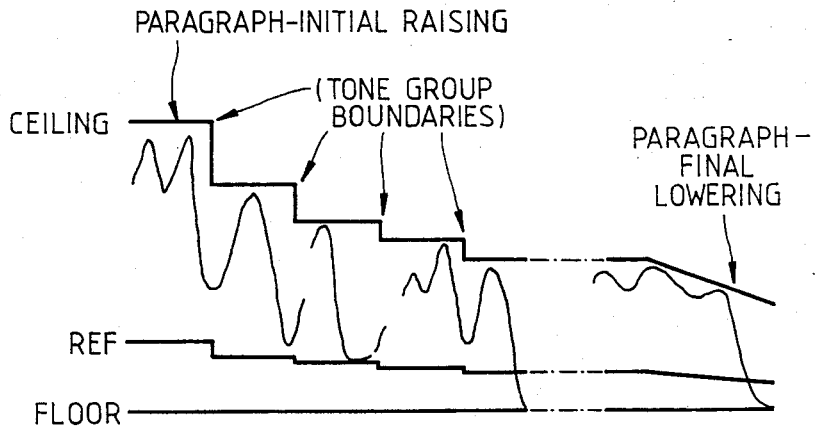
FIG. 5 illustrates graphically the variation of pitch over a paragraph.

At the beginning and end of a paragraph (signalled by unit 3 over the line PB) the pitch deviation is respectively increased and decreased by a factor. For example the factor might start at 1.9 and fall stepwise by 50% at every major phrase or tone group boundary, whilst at the end (e.g. the last two seconds of the paragraph) the factor might fall linearly down to 0.7 at the end. The application of this is illustrated in FIG. 5.

Again this procedure has the advantage of requiring only a limited amount of look-ahead, compared with the approach suggest by Thorsen ("Intonation and Text in Standard Danish", Journal of the Acoustical Society of America, vol 77, pp 1205–1216) where a continuous drop in pitch over a paragraph is proposed (requiring, therefore, look-ahead to the end of the paragraph). In the present proposal, the raising of pitch at the start of the paragraph requires no look-ahead; the initial tone group of the paragraph is subject to a boost of a given amount. Thereafter the factor for each successive tone group is computed relative to that of the immediately preceding tone group. Knowledge of the number of tone groups remaining is not required. The final lowering of course does require look-ahead to the end of the paragraph but this is limited to the duration of the lowering and is thus less onerous than the earlier proposal.

The above process will be illustrated using the paragraph:

"To delimit major phrases I simply rely on punctuation. Thus full stops, commas, brackets, and any other orthographic device that divides up a sentence into chunks will become a major phrase boundary."

The conversion unit 3 gives a allophonic representation of this, (though not shown as such below), with codes indicating paragraph boundaries (* used below), major phrase boundaries (:), tone group boundaries (.) and accents ( ) on content words (these are distinguished for the purpose of illustration by capital letters though the distinction does not have to be indicated by the conversion unit). The result is

* to DELÎMIT MÂJOR PHRÂSES: i SÎMPLY RELY on. PUNCTUATION: thus FÛLL STÔPS: CÔMMAS: BRÂCKETS: and any ÔTHER ORTHOGRÂPHIC DEVÎCE. that DIVÎDES. up a SÊNTENCE will BECÔME, a MÂJOR PHRÂSE BÔUNDARY*

Figure 6:
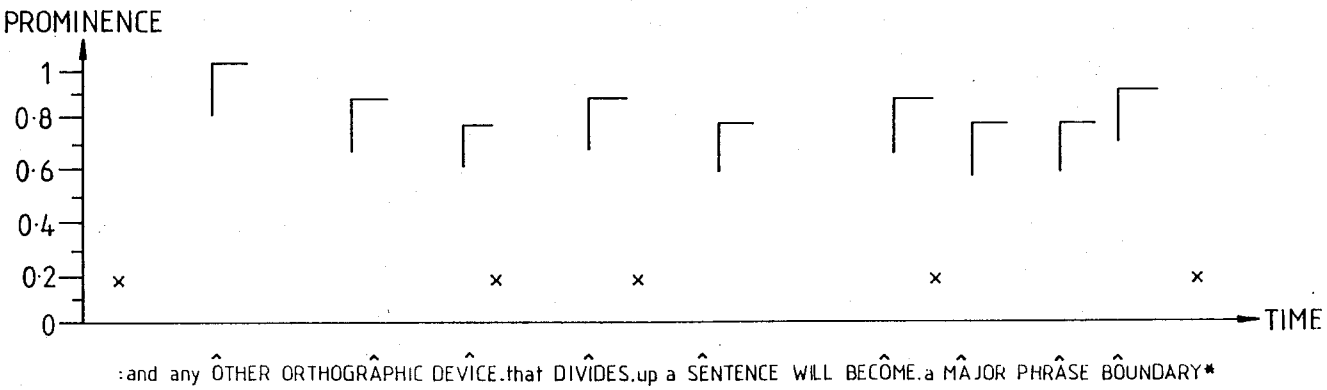
FIG. 6 shows the prominence features given to part of a sample paragraph.

The assignment of features to the major phrase beginning "any other orthographic" in accordance with the rules given above is illustrated in FIG. 6. Note the alternating accent levels and the minor phrase boundary features at 0.2.

Figure 7:
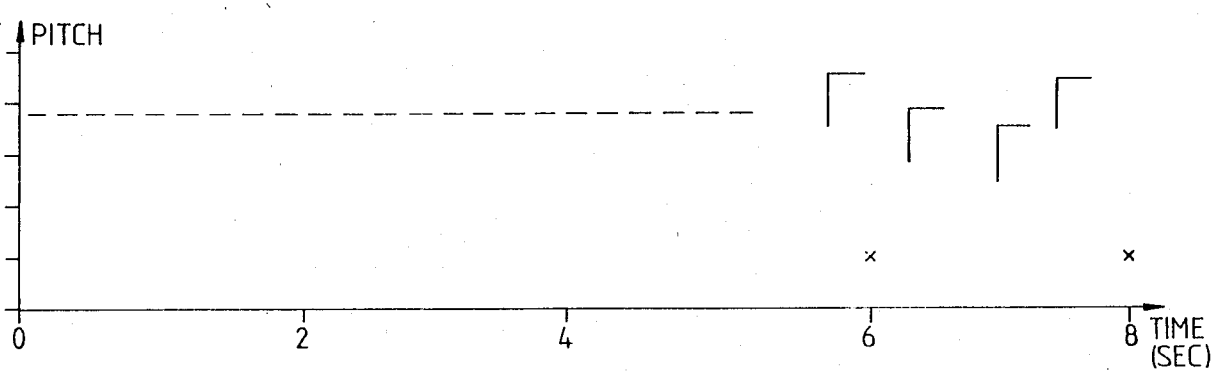
FIG. 7 shows the pitch corresponding to FIG. 6.

As this phrase occurs at the end of the paragraph, when the paragraph is converted to pitch as shown in FIG. 7, the lowering over the final two seconds moves the last few features down.

Returning now to FIG. 1, the data representing the features are passed firstly to an interpolator 10, which simply interpolates values linearly between the features, to produce a regular sequence of pitch samples (corresponding to the same 10 ms intervals as the parameters output from the conversion unit 4) and thence to a filter 8 which applies to the interpolated samples a filtering operation using a Hamming window.

Figure 8:
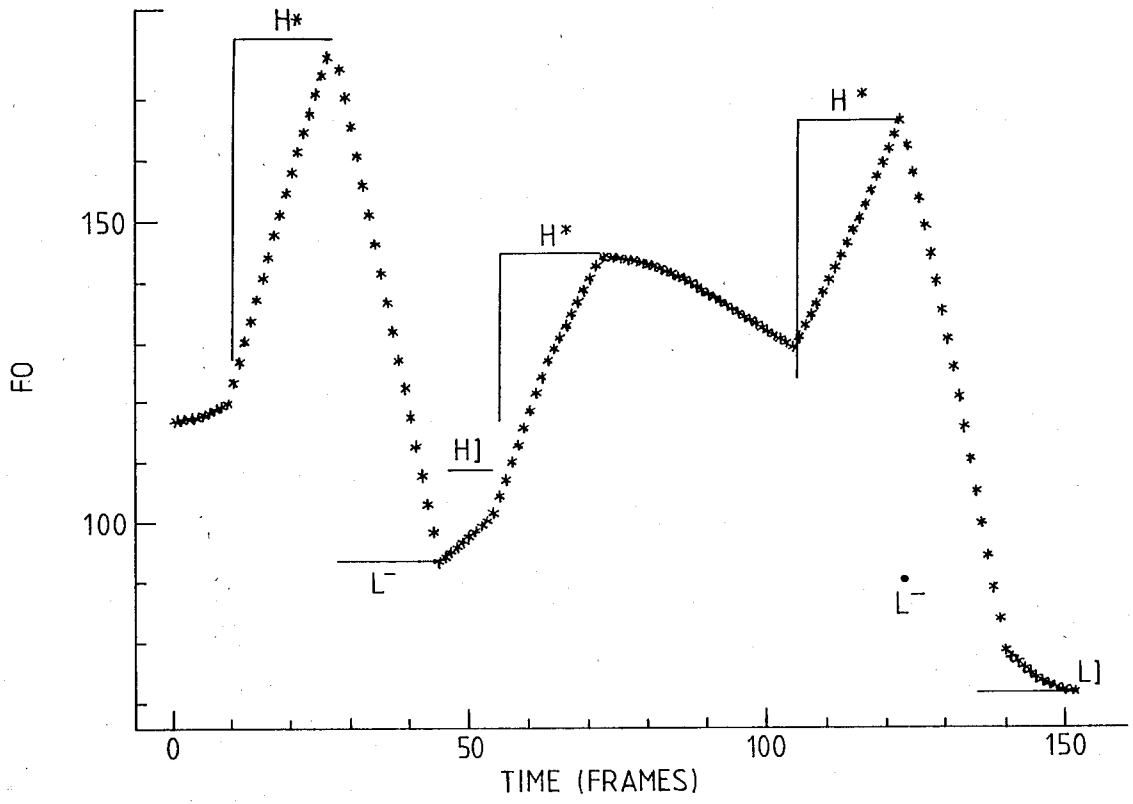
FIGS. 8 and 9 illustrate the process of smoothing the pitch contour.
Figure 9:
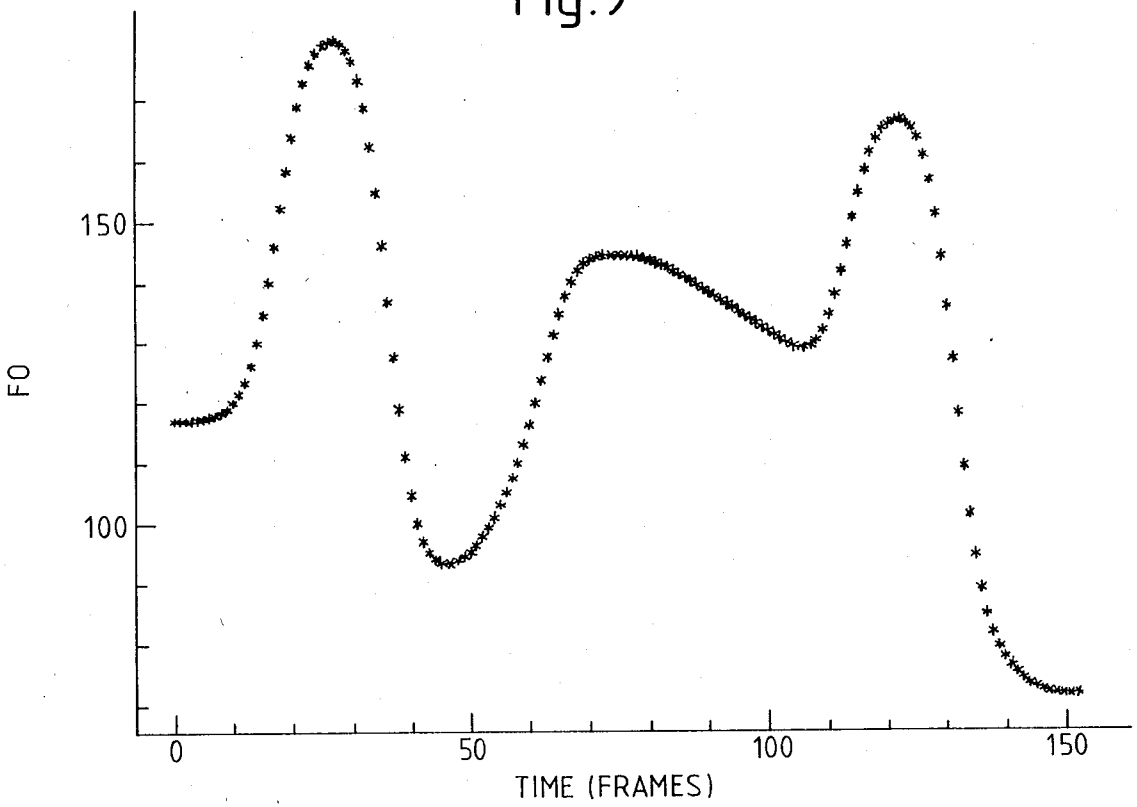

FIG. 8 illustrates this process, showing some features, and the smoothed result using a rectangular window. However, a raised cosine window is preferred, giving (for the same features) the result shown in FIG. 9.

The filtered samples control the frequency of the excitation generator 7, whose output is supplied to the formant synthesiser 3, which, it will be recalled, also receives information to determine the formant filter parameters, and voiced/unvoiced information (to select as is conventional between the output of the noise generator 6 and that of the excitation generator 7) from the conversion unit 4.

An additional feature which may be applied to the apparatus concerns the accent information generated in the conversion unit 3. Noting the lower contextual significance of a content word which is a repetition of a recently uttered word, the unit 3 serves to de-accent such repetitions. This is achieved by maintaining (in a word store 12) a first-in-first out list of (e.g.) thirty or forty most recent content words. As each content word in the input text is considered for accenting, the unit compares it with the contents of the list. If it is not found, it is accented and the word is placed at the top of the list (and the bottom word is removed from the list). If it is found, it is not accented, and is moved to the top of the list (so that multiple close repetitions are not accented).

It may be desirable to block the deaccenting process over paragraph boundaries, and this can be readily achieved by erasing the list at the end of each paragraph.

This variant could be further improved by making the test for deaccenting closer to a true semantic judgement, for example by applying the repetition test to the stems of content words rather than the whole word. Stem extraction is a feature already available (for pronunciation analysis) in some text to speech synthesisers.

Although the various functions discussed are, for clarity, illustrated in FIG. 1 as being performed by separate devices, in practice many of them may be carried out by a single unit.

What I claim is:

1. A speech synthesiser comprising:

(a) means for deriving, from coded text input thereto, phonetic data indicative of the properties of a synthesis filter and accent data indicating the occurrence of accents on words and to identify phrase groups of words delimited by punctuation marks;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein each phrase group comprises one or more subgroups and the deriving means are arranged in operation in response to paragraph division within the text to produce a pitch contour which, for a given textual content, is, for each of a plurality of subgroups at the commencement of a paragraph, higher than for a subgroup at an intermediate part of a paragraph by a factor which, falls from a value greater than unity at the commencement of the paragraph to a value of unity at said intermediate part, the factor falling stepwise at the boundary between each one of said plurality of subgroups, and the subgroup which follows it.

2. A speech synthesiser according to claim 1 in which the said factor falls at each subgroup by a constant proportion of its previous value.

3. A speech synthesiser comprising:

(a) means for deriving, from coded text input thereto, phonetic data indicative of the properties of a synthesis filter and accent data indicating the occurrence of accents on words and to identify phase groups of words delimited by punctuation marks;

(b) means for deriving from the accent data a pitch contour;

(c) an excitation generator responsive to the pitch contour to produce an excitation signal of varying pitch;

(d) filter means responsive to the phonetic data to filter the excitation signal to produce synthetic speech; wherein each phrase group comprises one or more subgroups and the deriving means are arranged in operation in response to paragraph division within the text to produce a pitch contour which, for a given textual content, is for each of a plurality of subgroups at the commencement of a paragraph, higher than for a subgroup at an intermediate part of a paragraph by a factor which, falls from a value greater than unity at the commencement of the paragraph to a value of unity at said intermediate part, the factor falling stepwise at the boundary between each one of said plurality of subgroups, and the subgroup which follows it; and (e) means assigning each word to a first class having a relatively high contextual significance or a second class having a relatively lower contextual significance and the boundaries between subgroups are defined as occurring after any word of the first class which is followed by a word of the second class.

4. A speech synthesiser comprising:

(a) means for deriving, from coded text input thereto, phonetic data indicative of the properties of a synthesis filter and accent data indicating the occurrence of accents on words and to identify phrase groups of words delimited by punctuation marks;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein the deriving means are arranged in operation to assign pitch representative values to the accents within each phrase group, the values comprising:

(i) a first value assigned to the first accent in the group;

(ii) a second value, lower than the last, assigned to the first accent in the group; and (iii) further values, lower than the first and second values, assigned to the remaining accents in the group such that the majority of those further values form a sequence in which the difference between successive values is alternately positive and negative;

and to derive a pitch contour from those values; and wherein the further values consist of a third value and a fourth value lower than the third, the last of the remaining accents is assigned the fourth value, and of the other remaining accents the first and odd numbered ones are assigned the third value and the even numbered ones are assigned the fourth value.

5. A speech synthesiser according to claim 4 in which each phrase group comprises one or more subgroups and pitch values are also assigned to boundaries between subgroups.

6. A speech synthesiser comprising:

(a) means for deriving, from coded text input thereto, phonetic data indicative of the properties of a synthesis filter and accent data indicating the occurrence of accents on words and to identify phrase groups of words delimited by punctuation marks;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein the deriving means are arranged in operation to assign pitch representative values to the accents within each phrase group, the values comprising:

(i) a first value assigned to the first accent in the group;

(ii) a second value, lower than the last, assigned to the first accent in the group; and (iii) further values, lower than the first and second values, assigned to the remaining accents in the group such that the majority of those further values form a sequence in which the difference between successive values is alternately positive and negative;

and to derive a pitch contour from those values; and wherein each phrase group comprises one or more subgroups and the deriving means is arranged in operation in response to paragraph division within the text to produce a pitch contour which, for a given textual content, is, for each of a plurality of subgroups at the commencement of a paragraph higher than for a subgroup at an intermediate part of a paragraph by a factor which falls from a value greater than unity at the commencement of the paragraph to a value of unity of said intermediate part, the factor falling stepwise at the boundary between each one of said plurality of subgroups and the subgroup which follows it.

7. A speech synthesiser according to claim 6 in which the said factor falls at each subgroup by a constant proportion of its previous value.

8. A speech synthesiser comprising:

(a) means for deriving, from coded text input thereto, phonetic data indicative of the properties of a synthesis filter and accent data indicating the occurrence of accents on words and to identify phrase groups of words delimited by punctuation marks;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein the deriving means are arranged in operation to assign pitch representative values to the accents within each phrase group, the values comprising:

(i) a first value assigned to the first accent in the group;

(ii) a second value, lower than the last, assigned to the first accent in the group; and (iii) further values, lower than the first and second values, assigned to the remaining accents in the group such that the majority of those further values form a sequence in which the difference between successive values is alternately positive and negative;

and to derive a pitch contour from those values; and wherein the deriving means is arranged in operation to derive the pitch contour from the values by (a) linear interpolation between the values and (b) filtering of the resulting contour.

9. A speech synthesiser comprising:

(a) means for deriving, from coded text input thereto, phonetic data indicative of the properties of a synthesis filter and accent data indicating the occurrence of accents on words;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein the deriving means are arranged in operation to suppress accents on words which, in accordance with a predetermined criterion, resemble words previously processed, wherein the predetermined criterion is one of identity of words.

10. A speech synthesiser comprising:

(a) means for deriving, from coded text input thereto, phonetic data indicative of the properties of a synthesis filter and accent data indicating the occurrence of accents on words;

(b) means for deriving from the accent data a pitch contour;

(c) an excitation generator responsive to the pitch contour to produce an excitation signal of varying pitch; and (d) filter means responsive to the phonetic data to filter the excitation signal to produce synthetic speech; wherein the deriving means are arranged in operation to suppress accents on words which, in accordance with a predetermined criterion, resemble words previously processed wherein the predetermined criterion is that the stem of the word is the same as that of the earlier word.

11. A speech synthesiser according to claim 9 or 10 in which the deriving means includes a store for storing a word list of predetermined size to which previously processed words are added, organized such that when a new word is added the least recently added word is discarded, the suppression of accents being performed only in respect of words resembling those in the list.

12. A speech synthesiser according to claim 11 in which the deriving means is arranged to recognise the end of a paragraph and, upon such recognition, to erase the list.

13. A speech synthesiser according to claim 1 or 3 wherein the deriving means are arranged in operation to suppress accents on words which, in accordance with a predetermined criterion, resemble words previously processed.

* * * * *